US006312110B1

(12) United States Patent
Darty

(10) Patent No.: US 6,312,110 B1
(45) Date of Patent: Nov. 6, 2001

(54) METHODS AND APPARATUS FOR ELECTROHYDRODYNAMIC EJECTION

(75) Inventor: Mark A. Darty, Bartlett, TN (US)

(73) Assignee: Brother International Corporation, Bridgewater, NJ (US)

( * ) Notice: Subject to any disclaimer, the term of this patent is extended or adjusted under 35 U.S.C. 154(b) by 0 days.

(21) Appl. No.: 09/667,810

(22) Filed: Sep. 22, 2000

Related U.S. Application Data

(60) Provisional application No. 60/156,432, filed on Sep. 28, 1999.

(51) Int. Cl.[7] ..... B41J 2/06

(52) U.S. Cl. ..... 347/55

(58) Field of Search ..... 347/55, 151, 120, 347/141, 154, 103, 123, 111, 159, 127, 128, 131, 125, 158; 399/271, 290, 292–295; 216/48, 4; 29/890.1; 430/311

(56) References Cited

U.S. PATENT DOCUMENTS

| | | | |
|---|---|---|---|
| 4,316,233 | | 2/1982 | Chato et al. . |
| 4,658,269 | | 4/1987 | Rezanka . |
| 4,801,955 | * | 1/1989 | Miura et al. . |
| 5,194,880 | * | 3/1993 | Elrod et al. . |
| 5,336,062 | | 8/1994 | Richter . |
| 5,598,195 | | 1/1997 | Okamoto et al. . |
| 5,754,205 | | 5/1998 | Miyata et al. . |
| 5,838,349 | | 11/1998 | Choi et al. . |

OTHER PUBLICATIONS

Dong Ho Choi et al. IS&T Final Program Proceedings, IS&T's Seventh International Congress on"Advances in Non–Impact Printing Technologies" vol. Two, pp. 49–58, 1991.

Dong Ho Choi et al., IS&T Final Program and Proceedings, IS&T's English International Congress on "Advances in Non–Impact Printing Technologies" pp. 334–339, 1992.

Tipler, P.A., Physics, Second Edition, Worth Publishers, Inc., New York, NY, 1982.

* cited by examiner

*Primary Examiner*—Raquel Yvette Gordon
(74) *Attorney, Agent, or Firm*—Oliff & Berridge, PLC

(57) ABSTRACT

An inkjet printhead in accordance with the invention includes a base that defines a channel. The channel defines an upper orifice that communicates with a reservoir containing ink and a lower orifice. At least one electrode is actuable to provide an electrostatic field within the channel so as to move ink from the upper orifice toward the lower orifice. The at least one electrode includes an upper electrode layer disposed at the upper orifice and a lower electrode layer disposed at the lower orifice.

34 Claims, 6 Drawing Sheets

Silicon nitride oxide polymer

METHODS AND APPARATUS FOR ELECTROHYDRODYNAMIC EJECTION

This application claims benefit of Provisional No. 60/156,432 filed Sept. 28, 1999.

BACKGROUND OF THE INVENTION

1. Field of Invention

The invention relates to methods and apparatus for electrohydrodynamic (hereinafter "EHD") ejection, and specifically to ink jet printers that eject ink via EHD.

2. Background of Related Art

Ink jet printers are playing an increasingly significant role in the printer art. This popularity is due at least in part to their improved resolution and relatively low cost compared to laser technology. Further, the emergence of digital photography has shifted the consumer printing market to low cost, photo-capable color ink jet printers. Higher resolution print heads are required to support market expectations for photographic quality. In fact, it has been estimated that by the year 2002, consumers may purchase more than 15 times as many photo-capable ink jet printers than dedicated photo printers per year.

Thus, an increasingly significant need exists for an ink jet printer that utilizes a high resolution print head.

SUMMARY OF THE INVENTION

It is therefore desirable to provide an ink jet printer that utilizes a high resolution print head. Specifically, it is desirable to provide pumping and ejecting apparatus of an ink jet printer print head that are very small and enable close spacing of nozzles, i.e., that have a fine nozzle pitch. It is further desirable to provide such methods and apparatus that provide consistent and reliable printing, wherein the relatively small ink droplets are satisfactorily controlled.

A high resolution print head in accordance with the invention provides at least some of these advantages by utilizing either an electrostatic field or a combination of electrodynamic and electrostatic fields to induce motion of a fluid, such as ink, within a nozzle of the print head. The motion of the fluid is induced by virtue of the interaction of the electric fields with charges within the fluid.

The nozzle in accordance with the invention can include a concentric ring of electrodes so as to cause directional motion of the ink within the nozzle, thereby providing improved control of the ejected ink stream. Specifically, by using separate electrode rings with different electric biasing, electric field behavior can be manipulated to introduce fluid motion that enhances nozzle performance.

This use of a directional electric field to force fluid down the nozzle in the vertical direction produces little lateral pressure on the sidewalls. Thus, the nozzle in accordance with the invention does not need to have thick silicon walls to handle large lateral fluid pressures, which allows smaller monolithic structures to be fabricated.

The invention also covers methods of manufacturing nozzles, such as via arisotropic etching (sacrificial etch) on silicon manufacturing techniques to yield small nozzle orifices. This process can yield a nozzle pitch of at least 2,000 nozzles per inch.

The apparatus manufactured according to this process can thereby be fabricated as a monolithic device, which obviates bonding several separate modules together and thus reduces the amount of silicon required for manufacture. The apparatus manufactured according to this process also does not have any moving parts, which enhances its operational reliability.

These and other features and advantages of this invention are described in, or are apparent from, the following detailed description of various exemplary embodiments of the systems and methods according to this invention.

BRIEF DESCRIPTION OF THE DRAWINGS

Various exemplary embodiments of systems and methods according to this invention will be described in detail, with reference to the following figures, wherein.

DETAILED DESCRIPTION OF PREFERRED EMBODIMENTS

Figure 1:
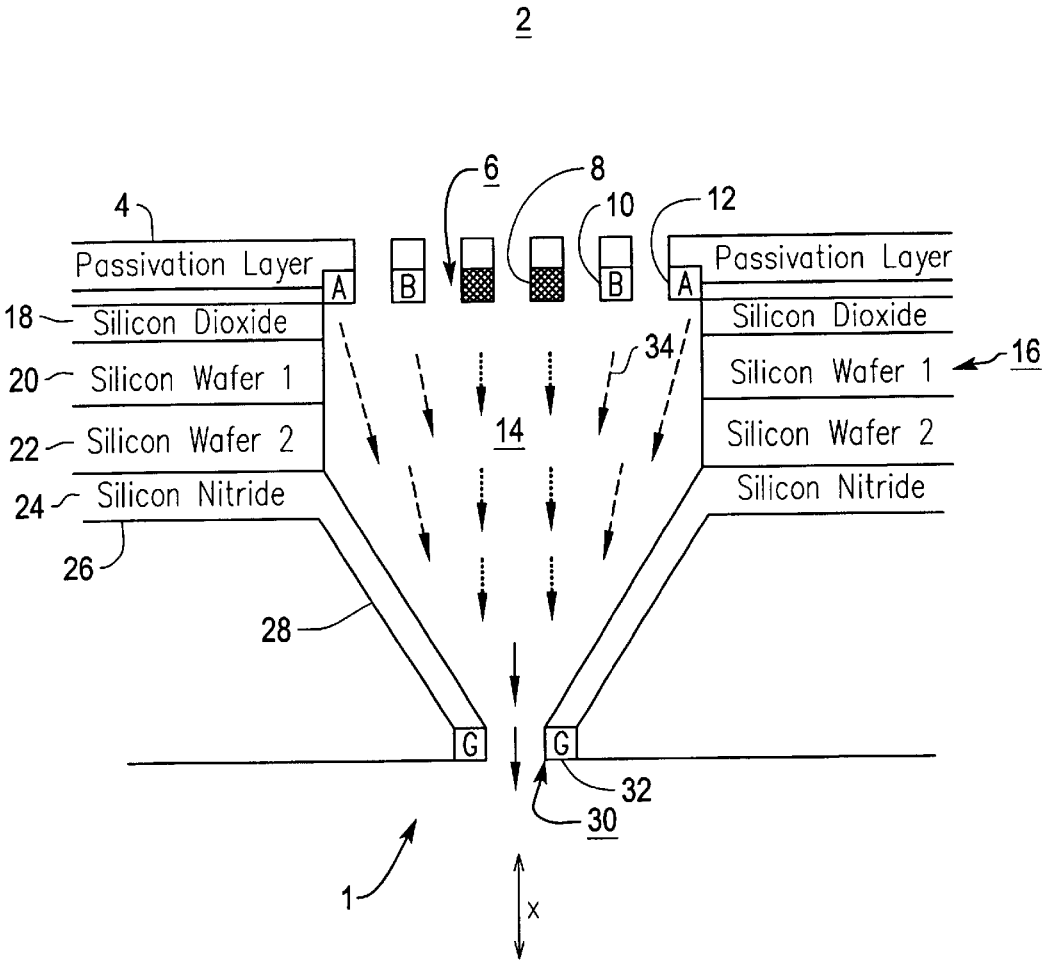
FIG. 1 is a schematic diagram that shows an EHD ink jet print head in accordance with an exemplary embodiment of the invention.

FIG. 1 is a schematic diagram that shows an EHD ink jet print head in accordance with an exemplary embodiment of the invention. Specifically, FIG. 1 shows an EHD ink jet print head 1 disposed at an ink reservoir 2.

The print head 1 includes a passivation layer 4. One side of the passivation layer 4 is adjacent the ink reservoir 2. An upper electrode layer 6 is disposed adjacent a side opposite to the one side of the passivation layer 4.

The upper electrode layer 6 includes an inner electrode ring 8, an outer electrode ring 12, and an intermediate electrode ring 10 disposed between electrode rings 8 and 12. The electrode rings 8, 10, 12 are disposed concentrically with respect to each other.

The electrode rings 8, 10, 12 are provided above and interior to a channel 14 defined by a silicon base 16. The silicon base 16 includes a silicon dioxide layer 18 disposed below and adjacent to the upper electrode layer 6. First and second silicon wafer layers 20, 22 are disposed below the silicon dioxide layer 18. A silicon nitride layer 24 is disposed below the second silicon wafer layer 22.

The silicon nitride layer 24 includes an upper section 26 that is disposed directly beneath the second silicon wafer layer 22, and a lower section 28 that extends downwardly and inwardly relative to the upper section 26 so as to define a substantially conical shape.

A lower electrode layer 30 is disposed beneath a lower surface of the lower section 28 of the silicon nitride layer 24. The lower electrode layer 30 includes a single electrode ring 32.

Gaps are defined within each of the electrode rings 8, 10, 12, 32, i.e., between ends of each of the electrode rings 8, 10, 12, 32. Gaps are also defined separating the electrode rings 8, 10, 12, 32 from each other. Ink disposed in the ink reservoir 2 can travel from the ink reservoir 2 through the print head 1 via the gaps.

The layers of the print head 1 discussed above define an ink jet nozzle. The passivation layer 4 and electrode layer 6 are therefore disposed at a top nozzle cavity. The lower electrode layer 30 is disposed at a lower nozzle cavity. FIG. 1 also shows that both the upper and lower electrode layers 6, 30 are not disposed outside of the respective nozzle cavities.

In operation, charged ink reacts with an electrostatic field provided by the upper and lower electrode layers 6, 30 so as to move the ink through the print head 1. Arrows 34 show the direction of travel of ink within the channel 14 of the print head 1.

Thus, the invention produces electric fields that extend at angles relative to a vertical axis x of the nozzle, thereby producing ion migration toward a center of the nozzle. Specifically, an electrostatic field is provided with force vectors both on axis and at angles with the axis of a tapered cone nozzle, such that the ink is concentrated toward the ejection orifice of the nozzle. Further, because of the disposition of the upper and lower electrode layers 6, 30, the invention is not limited to post ejection ink jet control, and instead is able to control ink within the channel 14 of the nozzle.

For example, the upper electrode layer 6 may operate as positive electrodes to inject charge into the fluid, and the lower electrode layer 30 may operate as a negative electrode to collect the charge. The three separate concentric electrode rings 8, 10, 12 of the upper electrode layer 6 can be excited with DC voltage to create electrostatic field vectors between the upper electrode layer 6 and the lower electrode layer 30, respectively.

Each of the electrode rings 8, 10, 12 of the upper electrode layer 6 can be biased identically, i.e., applying the same amount of voltage at the same time.

Alternatively, the electrode rings 8, 10, 12 can be biased differently.

Figure 2:
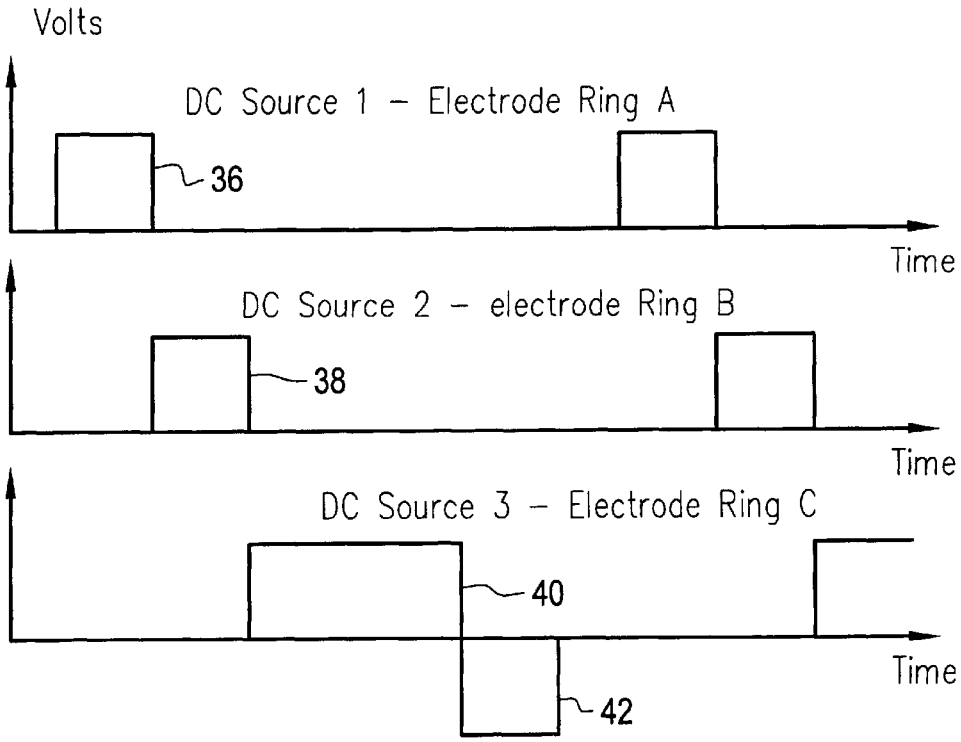
FIG. 2 is a chart of voltage versus time that shows an exemplary embodiment of biasing electrode rings differently.

FIG. 2 is a chart of voltage versus time that shows an exemplary embodiment of biasing the electrode rings 8, 10, 12 differently. Specifically, as shown in FIG. 2, voltage 36 is first applied to the outer electrode ring 12. Voltage 38 is then applied to intermediate electrode ring 10. Voltage 40 is then applied to inner electrode ring 8.

FIG. 2 shows that the same amount of voltage is applied to each of the electrode rings 8, 10, 12. However, the invention is intended to cover applying different amounts of voltage to the electrode rings 8, 10, 12.

FIG. 2 also shows that the voltage is applied to electrode rings 10, 12 for the same amount of time, while voltage is applied to the inner electrode ring 8 for a longer amount of time. Although, such an operation may provide desirable flow characteristics of ink through the nozzle, the invention is intended to cover the application of voltage to each of the electrode rings 8, 10, 12 for any amount of time. For example, voltage can be applied to all of the electrode rings 8, 10, 12 for the same amount of time. Alternatively, voltage can be applied to each of the electrode rings 8, 10, 12 for a different amount of time.

FIG. 2 further shows that oppositely charged voltage 42 can be applied to the inner electrode ring 8 after voltage 40 is applied. Applying voltage 42 to electrode ring 8 may operate as a valve to control and limit the amount of ink ejected from the nozzle. Applying voltage 42 may also serve to shape droplets ejected from the nozzle.

Figure 3:
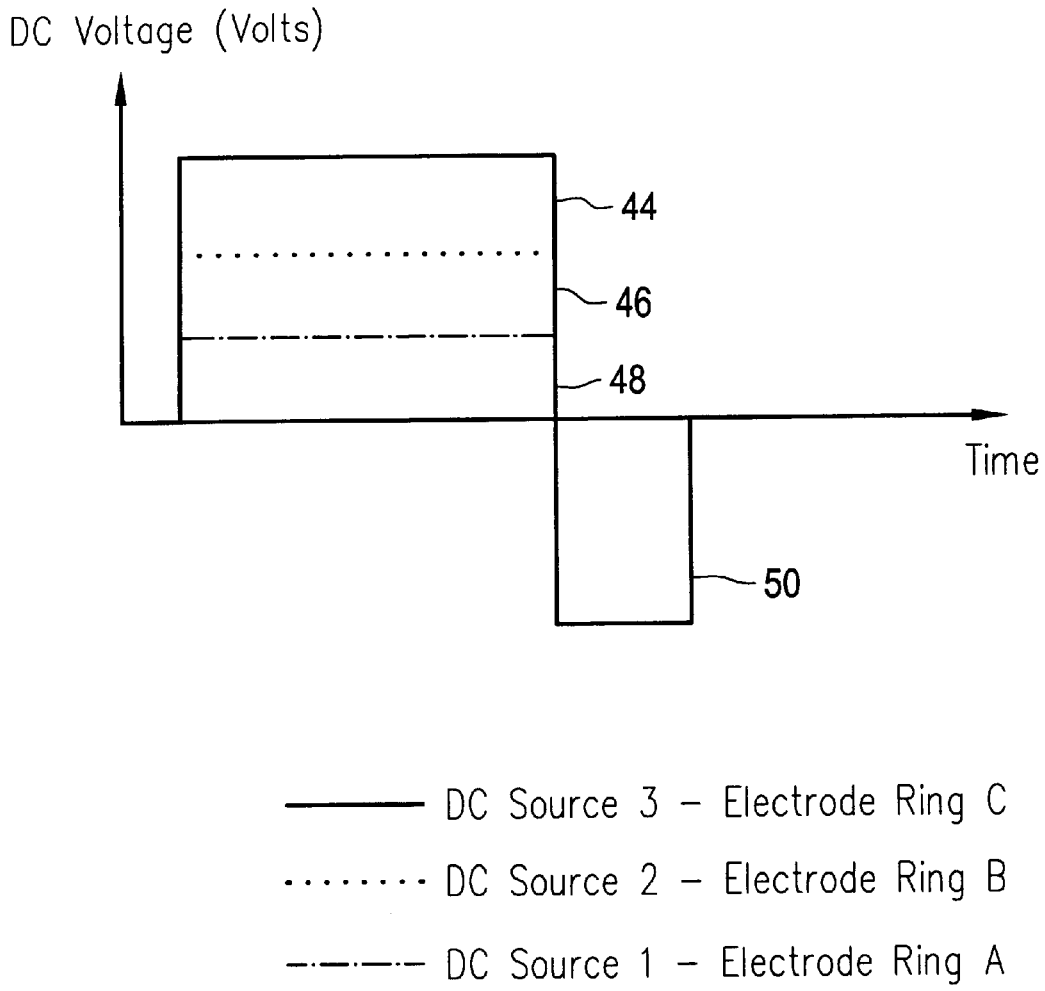
FIG. 3 is a chart of voltage versus time that shows an alternative exemplary embodiment of biasing electrode rings differently.

FIG. 3 is a chart of voltage versus time that shows an alternative exemplary embodiment of biasing electrode rings 8, 10, 12 differently. Specifically, FIG. 3 shows that different amounts of voltage are applied to each of the electrode rings 8, 10, 12 for the same amount of time. For example, the amount of voltage 44 applied to electrode ring 8 is greater than the amount of voltage 46 applied to electrode ring 10, which is greater than the amount of voltage 48 applied to electrode ring 12. However, voltages 44, 46, 48 are applied to electrode rings 8, 10, 12 for the same amount of time.

FIG. 3 also shows that oppositely charged voltage 50 can be applied to the inner electrode ring 8 after voltages 44, 46, 48 are applied. As discussed above, applying voltage 50 may operate as a valve to control and limit the amount of ink ejected from the nozzle and/or shape droplets ejected from the nozzle.

Oppositely charged voltages 42, 50 have been discussed above in terms of being applied to the inner electrode ring 8. However, the invention is intended to cover applying such oppositely charged voltages to any or all of the electrode rings 8, 10, 12. The oppositely charged voltages 42, 50 do not even have to be applied after voltage is applied to the inner electrode 8, and instead can be applied at any time. In fact, the invention is intended to cover methods and apparatus that do not include applying any oppositely charged voltage at all.

The methods and apparatus discussed above apply voltage to the entire electrode ring for each of the electrode rings 8, 10, 12. In other words, when voltage is applied to electrode ring 8, for example, the voltage is applied to all of electrode ring 8 at substantially the same amount of time. The voltage can therefore be applied to electrode 8, which can be contiguous, via a single lead. The same operation can occur for electrode rings 10, 12.

However, the invention is also intended to cover methods and apparatus that apply voltage to different segments of each of the electrode rings 8, 10, 12 at different times. For example, FIG. 4 is a top view of electrode rings 8, 10, 12 in accordance with an alternative exemplary embodiment of the invention, wherein voltage is applied to different segments of each of electrode rings 8, 10, 12 at different times.

Figure 4:
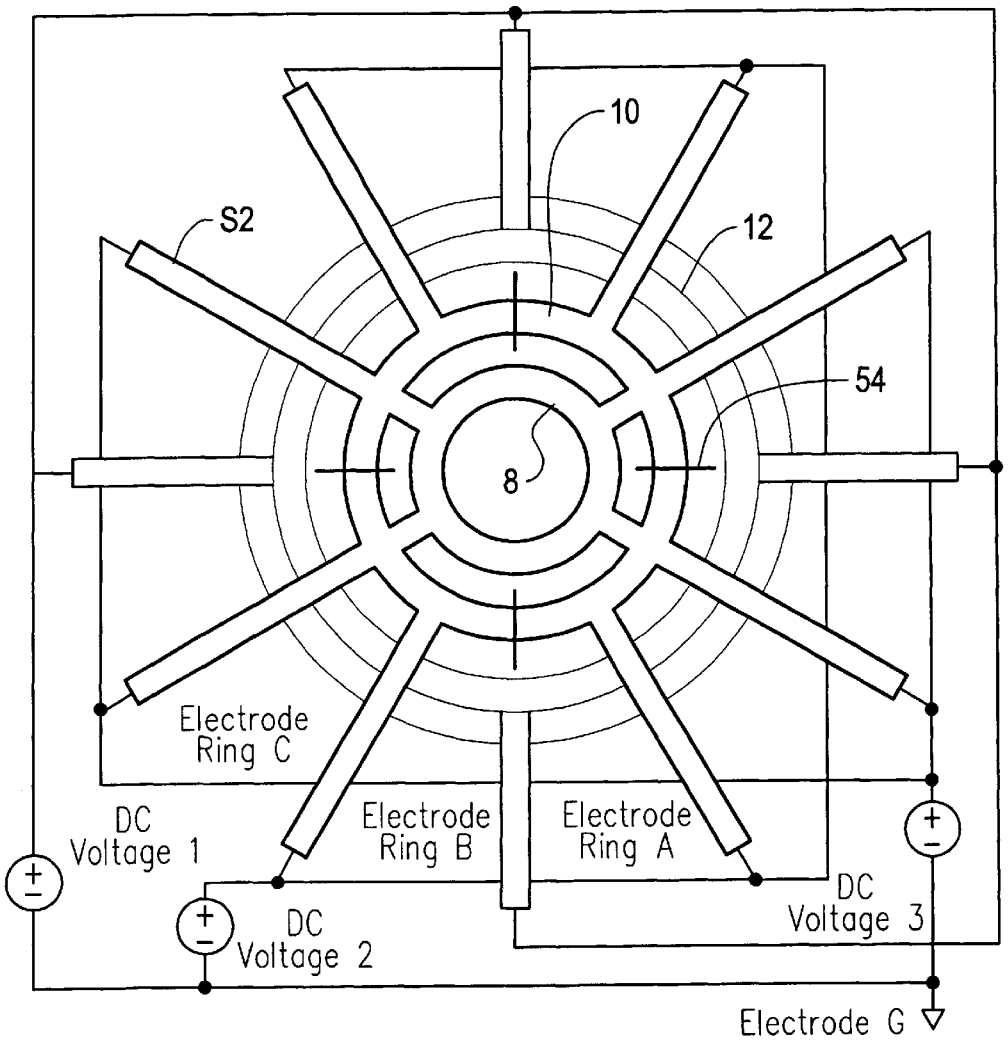
FIG. 4 is a top view of electrode rings in accordance with an alternative exemplary embodiment of the invention wherein voltage is applied to different segments of each of the electrode rings at different times.

Specifically, FIG. 4 shows four leads 52 connected to each of electrode rings 8, 10, 12. Each of the electrode rings 8, 10, 12 can be segmented into four segments. For example, electrode rings 8, 10, 12 can be segmented such that each segment extends to a position substantially midway between the leads 52. Such positions are designated by lines 54 for electrode ring 10. The segments can be electrically insulated from each other.

As shown in FIG. 4, leads 52 can be connected to different voltage sources so as to sequentially supply voltage to segments of the electrode rings 8, 10, 12. For example, each segment of the electrode rings 8, 10, 12 can be energized using either a DC pulsing voltage or a multi-phase AC voltage. Electrical biasing can be performed so as to superimpose a time varying electric field component over the DC biasing arrangement.

The time varying electric field may tend to rotate the charge in a circular motion as it is pulled down toward the electrode layer 30 by the DC electrostatic field component previously discussed. Such cyclone motion may help concentrate the stream of ink ejecting from the lower nozzle orifice, thereby improving control. Since all time varying signals will have a DC offset voltage, electrostatic ion migration between the upper and lower electrode layers 6, 30 will be used to induce fluid motion in the vertical direction between the ink reservoir 2 and the lower nozzle orifice.

Thus, the exemplary embodiment of FIG. 4 is able to impart a spiral motion on the fluid as the fluid moves down the channel 14, thereby creating a cyclone effect that may enhance post ejection drop formulation and associated control fidelity.

Figure 5:
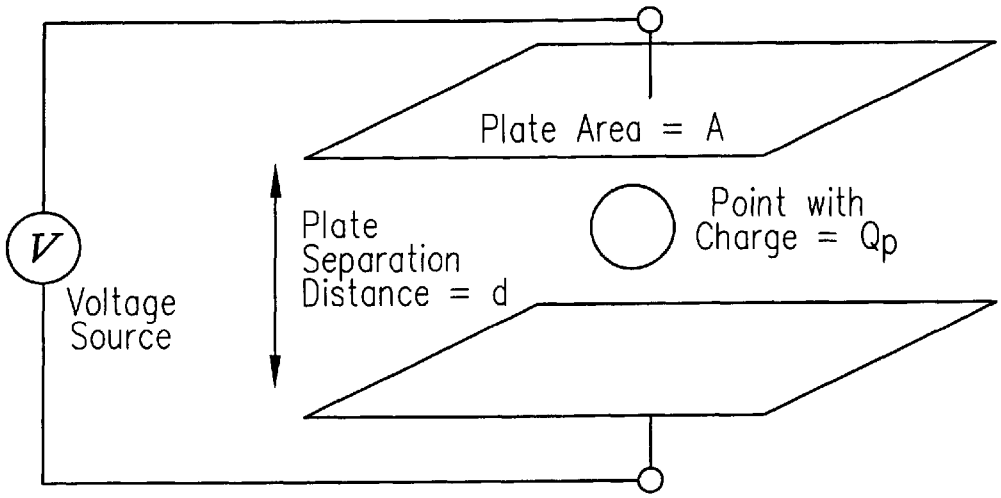
FIG. 5 is a schematic diagram of a parallel plate capacitor and particle disposed therein, which is provided for purposes of describing the operation of DC electric fields applied in accordance with various exemplary embodiments of the invention.

The DC electric fields that are applied in accordance with all of the exemplary embodiments discussed above operate pursuant to known and accepted physics theories. These theories can be described in accordance with the behavior of a charged particle disposed in an electric field that results from an applied voltage on a parallel plate capacitor. FIG. 5 is a schematic diagram of a parallel plate capacitor and particle disposed therein, which is provided for purposes of describing the operation of DC electric fields applied in accordance with various exemplary embodiments of the invention.

The charge of the parallel plate capacitor can be represented as follows:

$$Q = \frac{V\varepsilon A}{d};$$

wherein E is the permittivity of the medium separating the plates,

σ is the conductivity of the medium,

V is the applied voltage,

A is the area of the plate, and d is the distance separating the plates.

The electrostatic field energy between the plates can be represented as follows:

$$E = \frac{\sigma}{\varepsilon} = \frac{Q}{\varepsilon A} = \frac{V\varepsilon A}{d\varepsilon A} = \frac{V}{d}.$$

The force exerted on a particle with a charge $Q_p$ can then be represented as follows, assuming no other forces are considered:

$$F = Q_p E = \frac{Q_p V}{d}.$$

Figure 6:
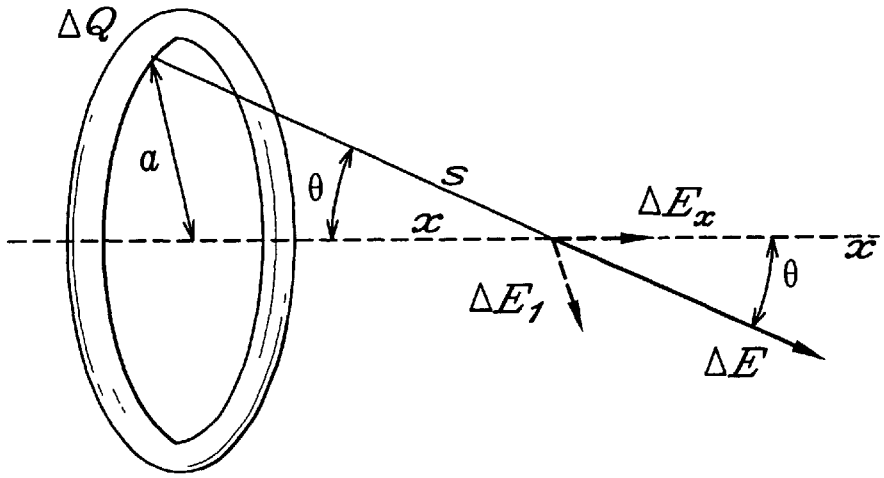
FIG. 6 is a schematic diagram that is provided to describe the effects of an electric field produced by rings similar to the electrode rings in accordance with various exemplary embodiments of the invention.
Figure 7A:
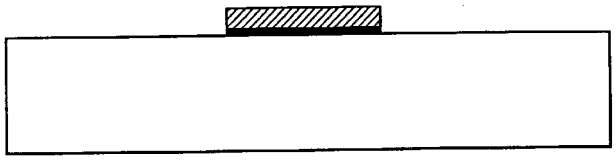
FIG. 7 is a schematic diagram that shows various steps (a)–(f) of a chemical etching process that can be utilized to produce a nozzle in accordance with the invention.
Figure 7B:
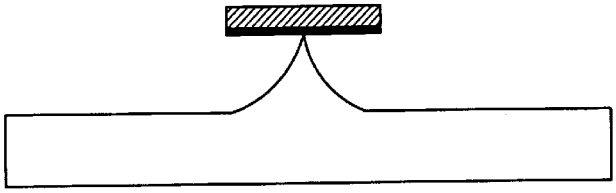
Figure 7C:
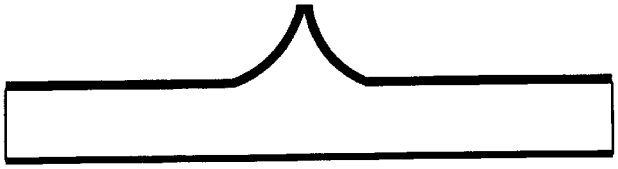
Figure 7D:
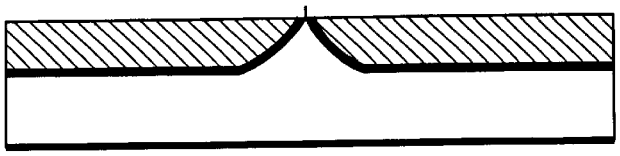
Figure 7E:
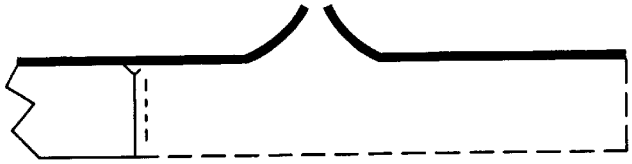
Figure 7F:
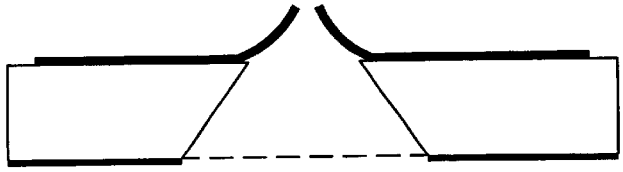
Figure 7F:
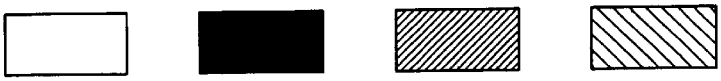

The above expressions illustrate that a charged particle in an electrostatic field will experience a force tending to move the particle. However, FIG. 6 is a schematic diagram that is provided to describe the effects of an electric field produced by rings similar to the electrode rings in accordance with various exemplary embodiments of the invention. FIG. 6, as well as the above equations, are provided in Tipler, P. A., *Physics*, Second Edition, Worth Publishers, Inc., New York, N.Y., 1982. A continuous charge distribution is provided on the ring of FIG. 6 due to applied voltage. Since the charge is uniform around the ring, the resultant force vector is in the x direction. In accordance with the disclosure of Pond, S. F., Drop-On-Demand Ink Jet Transducer Effectiveness, IS &T Tenth International Congress on Advances in Non-Impact Printing Technologies, Oct. 30–Nov. 4, 1994, New Orleans, La., The electric field measured at a point on the x axis can be calculated as follows:

$$E_x \frac{kx}{(x^2 + a^2)^{3/2}} \Sigma \nabla Q = \frac{kQx}{(x^2 + a^2)^{3/2}}.$$

The Coulomb Constant k can then be represented as follows:

$$k = \frac{1}{4\pi\varepsilon_0}.$$

The above equations only describe basic theories, and must be modified to fully describe the methods and apparatus in accordance with the invention, such as where the upper and lower electrode rings have different diameters. As shown in FIG. 1, each of the concentric upper ring electrodes 8, 10, 12 operate as emitter electrodes to inject free charge into the dielectric fluid. The charges are collected at the lower ring electrode 32. An electrostatic field is set up across the fluid by electrically biasing the upper and lower electrode layers 6, 30 using a DC power supply.

As a result of the electric field acting on the fluid, the injected charge is propelled toward the nozzle exit orifice. The electric field interacts with the injected charge to create a force on the charge, which then transfers momentum to the fluid. While describing EHD motion due to current conduction in dielectric fluids is complex, a basic description can be provided via a few further introductory equations.

If it is assumed that the fluid motion is quasi-static, i.e., changing slowly with time, then a modified form of the above representation of the electric field in the x direction can be used to determine the force density of the electric field acting on the fluid, which can be represented as follows:

$$F = \rho E - \frac{E^2}{2} \nabla \varepsilon;$$

wherein F is the force density,

ρ is the free electric charge density in the fluid,

E is the electric field, and

∈ is the permittivity of the fluid.

The force and electric field will be vector quantities having both direction and magnitude.

This representation is a reduced form of a general equation for the pondermotive force density acting on a dielectric fluid with free space charge in the presence of an inhomogeneous electric field. Kelvin polarization force and the electromotive force were omitted to arrive at this representation. The Kelvin polarization force cannot lead to sustained fluid motion using DC fields and the electromotive force is applicable to compressible media.

Using conservation of charge in an electrostatic system, the following representation of conservation of charge can be provided:

$$\frac{\partial \rho}{\partial t} + v \cdot \nabla \rho + \frac{\sigma}{\varepsilon} \rho = \frac{\rho}{\varepsilon} E \cdot \nabla \varepsilon - E \cdot \nabla \sigma;$$

wherein p is the free electric charge density in the fluid,

E is the electric field,

∈ is the permittivity of the fluid,

σ is the conductivity of the fluid, t is time, and

ν is the incompressible fluid velocity.

This representation can be used to analyze the interaction between the applied electric field and the fluid.

This representation shows that a requirement for the existence of free charge is a spatial gradient in either conductivity or permittivity. This can be accomplished by either introducing a step change across a material boundary or by injecting charge into the volume itself. Charge injection into the fluid volume is described in accordance with at least the embodiment shown in FIG. 1.

If the properties of the fluid (in this case ink) and the desired nozzle ejection velocity are known, the above representation of conservation of charge can be solved using analytical and numerical techniques for the required electric field strength. Once the electric field strength is known, the above representation of Coulomb Constant in free space can be modified for the geometry of the proposed design and solved to determine the applied electrode voltage needed to produce the required velocity of ink exiting the nozzle.

Further, for fluids with slight conductivity, the use of temperature gradients in the fluid can also be used to generate free charge. Such a system may use solid ink technology where the temperature is highest at the point where the ink is melted and the fluid cools slightly as it traverses down the nozzle. In a system where free charge is generated by temperature gradients, the positive electrode will be placed directly in the fluid in a warmer region and the negative electrode will be positioned downstream in a cooler region of the liquid. The apparatus shown in FIG. 1 can be used with temperature gradient induced free charge by simply adding a heater to the ink reservoir shown, as would be the case in a solid ink printing system.

A full description of EHD theory and the associated equations as applied to the methods and apparatus of the invention is not provided since it is within the level of skill of one of ordinary skill in the art. For example, fluid motion effects and the geometry of the nozzle design can also be considered. A full analysis would involve numerical solution and computer simulation of the quasi-static continuity equation of the representation of conservation of charge discussed above.

The methods and apparatus discussed above provide high resolution printing via small ink jet print heads, which can be used for color printing. In particular, the above apparatus and methods utilize a device having a high nozzle pitch, with no moving parts, and that include a low cost, monolithic silicon substrate.

The nozzle density, and thus resolution, of the EHD apparatus and methods of the invention can be compared to other technologies of print heads, such as those utilizing piezoelectric and thermal transducers. This comparison can be made pursuant to area of the pixel, which can be represented as follows:

$$A_{pixel} = \frac{\pi}{(2R^2)}; \text{ and}$$

actuation packing efficiency, which can be represented as follows:

$$P_A = \frac{A_{chamber}}{A_{pixel}}.$$

The above representations can be applied to the EHD nozzle actuator in accordance with the invention. For example, if the EHD nozzle chamber can be assumed to be defined by a circle with a diameter of 12 microns, then the packing efficiency can be calculated.

This comparison can be made for 300 dpi and is dependent on the particular transducer design. In accordance with this comparison, wherein smaller numbers indicate closer nozzle spacing, the calculated packing density for a piezoelectric actuator is 8000, for a thermal actuator is 2, and for an EHD nozzle in accordance with the invention is 0.002.

Thus, at 300 dpi the thermal transducer has significantly greater packing density than the piezoelectric, and the proposed EHD nozzle actuator has a much better packing efficiency than either piezoelectric or thermal transducers. Since the EHD method and apparatus of the invention has a packing density less than one, it is fundamentally capable of higher resolution printing. The resolution limit, assuming pixel size is equal to nozzle spacing, can be calculated by setting $P_A$=1, and solving for R by inserting the representation of area of pixel into the representation of actuator packing efficiency. Performing the calculation on the EHD method and apparatus of the invention with nozzle pitch of 12 micron yields dpi=2,117. The resolution attainable depends on several factors, including the size and volume of the ink droplet produced by a particular nozzle design and the number of print passes allowed over the same area of the object which is being printed.

The invention discussed above can also be used in conjunction with post ejection ink droplet formation and control techniques in accordance with high speed and high resolution printing. EHD stimulation of ink after ejection from the nozzle can be used as a control method for continuous ink jet printers. In this technology, electric fields can be used to control the breakup of the ink stream into droplets. An electrically biased plate can be used to induce a charge in the falling ink droplet. Parallel plate electrodes can subsequently be used to create an electric field to deflect the path of the charged droplet for purposes of selectively printing certain drops and recycling others into an ink reservoir.

The invention is also intended to cover methods and apparatus for manufacturing the various exemplary embodiments of the EHD ink jet printers discussed above. For example, the nozzles in accordance with the invention can be manufactured pursuant to any silicon etching or drilling technique, including but not limited to copper vapor laser (CVL) drill, Eximer laser drill, and sacrificial etching of silicon to provide very small orifice diameters.

Specifically, the Copper Vapor Laser (CVL) can be used to drill small holes in silicon with excellent tolerance. In fact, CVL can be used to precisely drill holes in silicon, achieving diameters at least as low as 5 microns with tolerances of ±0.25 micron. However, CVL is a serial drilling process, wherein one hole at a time is drilled, which may not be desirable for volume production.

The Eximer Laser is another drilling method for fabricating small holes in metal. This method can be used to drill holes to achieve diameters at least as low as 5 microns with tolerances of ±1.0 micron. With the Eximer laser, many holes can be drilled in parallel using a mask technology similar to that used in standard VLSI chip manufacturing. Therefore, the Eximer laser approach may be faster than that of CVL drilling, even though the drill time per hole is longer.

However, laser drilling produces residue on the surface of the material. Metallic residue is generated around the hole on the surface of the metal. The metallic residue from laser drilling must be removed prior to further processing. Such material removal requires wafer cleaning, which may add expense and time to manufacturing. In addition, cleaning processes may not remove all metallic residue which could cause production yield problems for devices having extremely small features.

Another issue to be considered with laser drilling is the aspect ratio. The aspect ratio of the laser results in tapered holes where the inlet diameter of the hole is larger than the outlet diameter. Therefore, laser drilling in deep substrates can cause an increase in surface area per nozzle. For designs requiring pressure plates made of relatively thick silicon (100 microns, etc.), laser drilling may not be able to achieve as many nozzles per inch as sacrificial etching.

Using the combination of reactive ion and wet chemical etching processes, nozzles can be fabricated with very small orifice diameters on a single crystal silicon substrate. For example, nozzles with orifice diameters at least as low as 150 nm can be achieved.

FIG. 7 is a schematic diagram that shows various steps of a chemical etching process that can be used to produce a nozzle in accordance with the invention and which is accomplished pursuant to known techniques and equipment. FIG. 7 is disclosed in Farooqui, M. M., and Evans, A. G. R., *Microfabrication of Submicron Nozzles in Silicon Nitride*, Journal of Microelectromechanical Systems, 1, No. 2, 1992, 86–88. In step (f) of FIG. 7, an extension of the method illustrates how boron doped silicon nozzles can be built using an undoped silicon mold and back etching the substrate to provide structure for nozzle support.

The methods discussed above obviate bonding several micro-machined plates together via wafer bonding. Thus, the methods discussed above enable a monolithic silicon print head having a high nozzle density to be manufactured inexpensively. Thus, these methods can provide a nozzle with associated flow control apparatus in roughly a 12 micron by 12 micron square area, allowing nozzle spacing to be on roughly a 12 micron pitch, producing 2,117 nozzles per inch on a monolithic chip layout. Using a monolithic approach, which does not require bonding a significant number of wafer segments together, may reduce manufacturing cost sufficiently to enable the print head to be disposable.

Further, electrode formation via metalization can be accomplished in accordance with known VLSI chip manufacturing techniques.

FIG. 7 is only provided to show an exemplary sacrificial etching process which can be used to manufacture nozzles in accordance with the invention. However, the invention is intended to cover any multi-step chip fabrication technology wherein wafer level processing forms holes simultaneously which can be used to manufacture nozzles in accordance with the invention.

The various apparatus and methods in accordance with the invention discussed above achieve miniaturization so as to yield a nozzle pitch at least as small as 12 microns, which would provide 2,117 nozzles/inch. The apparatus and methods of the invention provide for enhanced control of ejected ink droplets. The invention also provides for the fabrication of small nozzles, such as by sacrificial etching which can produce orifice diameters at least as small as 5 micron.

However, various modifications can be made to the exemplary embodiments of the invention discussed above. For example, the upper electrode layer 6 of FIG. 1 includes three ring electrodes 8, 10, 12. However, the invention is intended to cover an upper electrode layer 6 that includes any number of electrode rings. In fact, the invention is intended to cover an upper electrode layer 6 that only includes a single electrode ring.

Also, the electrode rings 8, 10, 12 of at least some of the exemplary embodiments are discussed above as being circular. However, the invention is intended to cover electrode rings of any shape, such as rectangular, square, triangular, oval, etc.

The electrode ring 32 of the lower electrode layer is similarly not limited by number or shape.

The nozzle of FIG. 1 includes a passivation layer 4 to insulate the electrode rings 8, 10, 12 of the upper electrode layer 6. However, the invention is also intended to cover a print head that does not include any such passivation layer.

The silicon base 16 of FIG. 1 is shown as including silicon layers 18, 20, 22, 24. However, the invention is also intended to cover a silicon base that only includes a single layer. In fact, the base 16 does not have to be made of silicon, and can instead be made of any other suitable material.

The print heads in accordance with the invention are discussed above in terms of including very small nozzles and nozzle orifices. However, the invention is intended to cover nozzles and nozzle orifices of any size.

The invention is also intended to cover any sort of arrangement of any number of the exemplary embodiments of the nozzles discussed above. For example, the invention covers a print head that includes a single nozzle or an array of any number of such nozzles.

The apparatus and methods discussed above can be used with any fluid, such as ink having a suitable density, viscosity, particulate purity and electrical properties. In fact, the apparatus and methods of the invention do not have to be applied to ink jet printing. For example, the invention is intended to cover the manipulation of any fluid, such as for providing accurate amounts of medications.

In accordance with the EHD apparatus and methods discussed above, forces that cause fluid motion result from the interaction of electric fields and charges within the fluid. The electric fields discussed above are induced via charge injection, wherein electrical charge is injected into the fluid volume and an ionization current is established from an emitter to a collector positioned in direct contact with the fluid. A pressure gradiant develops between the emitter and the collector, which produces fluid motion. However, the invention is also intended to cover fluid motion by virtue of charge induction, wherein electric charge is generated at a fluid-fluid or fluid-solid boundary layer. Induction pumps can then be used to pull a fluid along a channel.

While the systems and methods of this invention have been described in conjunction with the specified embodiments outlined above, it is evident that many alternatives, modifications and variations will be apparent to those skilled in the art. Accordingly, the exemplary embodiments of the systems and methods of this invention, as set forth above, are intended to be illustrative, not limiting. Various changes may be made without departing from the spirit and scope of the invention.

What is claimed is:

1. An ink jet print head for use with a reservoir which contains ink, comprising:

a base that defines a channel, the channel defining an upper orifice that communicates with the reservoir and a lower orifice; and at least one electrode actuable to provide an electrostatic field within the channel so as to move ink from the upper orifice toward the lower orifice, the at least one electrode includes an upper electrode layer disposed at the upper orifice and a lower electrode layer disposed at the lower orifice, the upper electrode layer including at least three upper electrode rings that are disposed concentrically relative to each other, each of the at least three upper electrode rings being segmented into multiple segments that are electrically insulated with respect to each other, the multiple segments being actuable by a time varying electric field.

2. The ink jet print head according to claim 1, wherein the three upper electrode rings are circular, a center of each of the three upper electrode rings being aligned with an axis of the channel.

3. The ink jet print head according to claim 2, wherein the lower electrode layer includes a lower electrode ring.

4. The ink jet print head according to claim 3, wherein the lower electrode ring is circular, a center of the lower electrode ring being aligned with the axis of the channel.

5. The ink jet print head according to claim 4, wherein the three upper electrode rings and the lower electrode ring are actuable so as to provide force vectors both along the axis of the channel and at angles relative to the axis of the channel so as to concentrate movement of ink toward the lower orifice.

6. The ink jet print head according to claim 1, further including a passivation layer disposed at least in part at an upper surface of the upper electrode layer between the upper electrode layer and the reservoir.

7. The ink jet print head according to claim 1, wherein the base is made of silicon.

8. The ink jet print head according to claim 7, wherein the base includes a silicon dioxide layer.

9. The ink jet print head according to claim 8, wherein the base includes a first silicon wafer layer disposed below the silicon dioxide layer.

10. The ink jet print head according to claim 9, wherein the base includes a second silicon wafer layer disposed between the first silicon wafer layer.

11. The ink jet print head according to claim 10, wherein the base includes silicon nitride layer disposed below the other silicon wafer layer.

12. The ink jet print head according to claim 11, wherein the silicon nitride layer is conically shaped such that the base defines a nozzle, the lower electrode layer being disposed at a lower surface of the silicon nitride layer, the upper electrode layer being disposed adjacent the silicon dioxide layer.

13. The ink jet print head according to claim 1, wherein the three upper electrode rings are actuated by supplying the three upper electrode rings with voltage of one polarity, the voltage being supplied to each of the three upper electrode rings at a different time.

14. The ink jet print head according to claim 14, wherein a substantially equal amount of voltage is supplied to each of the three upper electrode rings.

15. The ink jet print head according to claim 14, wherein the three upper electrode rings include an inner electrode ring, an outer electrode ring, and an intermediate electrode ring disposed between the inner and outer electrode rings, the voltage being supplied to the inner electrode ring for a longer amount of time than the outer and intermediate electrode rings.

16. The ink jet print head according to claim 15, wherein voltage of a polarity that is opposite to the one polarity is supplied to at least the inner electrode ring.

17. The ink jet print head according to claim 16, wherein voltage of the one polarity is initially applied to the outer electrode ring, voltage of the one polarity is then applied to the intermediate electrode ring, voltage of the one polarity is then applied to the inner electrode ring, and voltage of the polarity that is opposite to the one polarity is then applied to the inner electrode ring.

18. The ink jet print head according to claim 1, wherein actuation of the multiple segments via the time varying electric filed rotates a charge within the channel so as to impart spiral motion to the ink.

19. A method of manufacturing the ink jet print head according to claim 1, comprising the step of performing a sacrificial etching process to form one or more orifices.

20. An ink jet print head for use with a reservoir which contains ink, comprising:

a base that defines a channel, the channel defining an upper orifice that communicates with the reservoir and a lower orifice; and at least one electrode actuable to provide an electrostatic field within the channel so as to move ink from the upper orifice toward the lower orifice, the at least one electrode includes an upper electrode layer disposed at the upper orifice and a lower electrode layer disposed at the lower orifice, the upper electrode layer including at least three upper electrode rings that are disposed concentrically relative to each other, the at least three upper electrode rings being actuated by supplying the at least three upper electrode rings with voltage of one polarity, the voltage being supplied to each of the at least three upper electrode rings at the same time.

21. The ink jet print head according to claim 20, wherein a different amount of voltage is supplied to each of the three upper electrode rings.

22. The ink jet print head according to claim 21, wherein the three upper electrode rings include an inner electrode ring, an outer electrode ring, and an intermediate electrode ring disposed between the inner and outer electrode rings, a larger amount of voltage being supplied to the inner electrode ring than the intermediate electrode ring, and a larger amount of voltage being supplied to the intermediate electrode ring than the outer electrode ring.

23. The ink jet print head according to claim 22, wherein voltage of a plurality that is opposite to the one polarity is supplied to at least the inner electrode ring.

24. A method of manipulating a fluid, comprising the steps of:

providing an electric field with a channel defined by a base, the electric field reacting with the fluid to move the fluid from an upper orifice of the channel toward a lower orifice of the channel, the providing step including providing an electric field via an upper electrode layer disposed at the upper orifice and a lower electrode layer disposed at the lower orifice, the providing step including actuating the upper electrode layer so as to provide force vectors both along an axis of the channel and at angles relative to the axis of the channel so as to concentrate movement of the fluid toward the lower orifice, the providing step including providing an electric field via an upper electrode layer that includes at least three concentrically disposed electrode rings, the at least three electrode rings including an inner electrode ring, an outer electrode ring, and an intermediate electrode ring disposed between the inner and outer electrode rings; and electrically insulating the at least three electrode rings relative to each other.

25. The method according to claim 24, further including the step of supplying the three electrode rings with voltage of one polarity, the voltage being supplied to each of the three electrode rings at a different time.

26. The method according to claim 25, wherein the step of supplying includes supplying a same amount of voltage to each of the three electrode rings.

27. The method according to claim 26, wherein the step of supplying includes supplying voltage to the inner electrode ring for a longer amount of time than the outer and intermediate electrode rings.

28. The method according to claim 27, further including the step of supplying voltage of a polarity that is opposite to the one polarity to at least the inner electrode ring.

29. The method according to claim 28, wherein the supplying steps include initially supplying voltage of the one polarity to the outer electrode ring, subsequently supplying voltage of the one polarity to the intermediate electrode ring, subsequently supplying voltage of the one polarity to the inner electrode ring, and subsequently supplying voltage of the polarity that is opposite to the one polarity to the inner electrode ring.

30. The method according to claim 29, further including the step of supplying the three electrode rings with voltage of one polarity, the voltage being supplied to each of the three electrode rings at the same time.

31. The method according to claim 30, wherein the step of supplying includes supplying a different amount of voltage to each of the three electrode rings.

32. The method according to claim 31, wherein the step of supplying includes supplying a larger amount of voltage to the inner electrode ring than the intermediate electrode ring, and supplying a larger amount of voltage to the intermediate electrode ring than the outer electrode ring.

33. The method according to claim 32, further including the step of supplying voltage of a polarity that is opposite to the one polarity to at least the inner electrode ring.

34. The method according to claim 24, further including the steps of segmenting each of the three electrode rings into separate electrically insulated segments, and actuating the multiple segments via a time varying electric field so as to rotate a charge within the channel to impart spiral motion to the fluid.

* * * * *